US007690423B2

(12) United States Patent
Del Campo et al.

(10) Patent No.: US 7,690,423 B2
(45) Date of Patent: Apr. 6, 2010

(54) DOWNHOLE TOOL HAVING AN EXTENDABLE COMPONENT WITH A PIVOTING ELEMENT

(75) Inventors: Christopher S. Del Campo, Houston, TX (US); Alexander F. Zazovsky, Houston, TX (US); Stephane Briquet, Houston, TX (US); Steve Ervin, Brookshire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 378 days.

(21) Appl. No.: 11/766,364

(22) Filed: Jun. 21, 2007

(65) Prior Publication Data

US 2008/0314587 A1 Dec. 25, 2008

(51) Int. Cl.
*E21B 49/10* (2006.01)

(52) U.S. Cl. ..... 166/100; 73/152.23; 73/152.26

(58) Field of Classification Search ..... 166/100, 166/186, 381, 250, 312, 264; 73/152.55, 73/152.23, 152.26, 152.22, 152.27, 152.51
See application file for complete search history.

(56) References Cited

U.S. PATENT DOCUMENTS

| | | | | |
|---|---|---|---|---|
| 2,892,501 | A * | 6/1959 | Boller | 166/100 |
| 3,677,081 | A * | 7/1972 | Newton et al. | 73/152.24 |
| 3,934,468 | A | 1/1976 | Brieger | |
| 4,860,581 | A | 8/1989 | Zimmerman et al. | |
| 4,893,505 | A | 1/1990 | Marsden et al. | |
| 4,936,139 | A | 6/1990 | Zimmerman et al. | |
| 5,622,223 | A | 4/1997 | Vasquez | |
| 5,881,807 | A * | 3/1999 | Boe et al. | 166/100 |
| 6,301,959 | B1 * | 10/2001 | Hrametz et al. | 73/152.23 |
| 6,964,301 | B2 | 11/2005 | Hill et al. | |
| 7,121,338 | B2 * | 10/2006 | van Zuilekom et al. | 166/264 |
| 7,263,881 | B2 * | 9/2007 | Ramakrishnan | 73/152.55 |
| 2006/0075813 | A1 * | 4/2006 | Fisseler et al. | 73/152.26 |
| 2008/0156487 | A1 * | 7/2008 | Zazovsky et al. | 166/264 |

* cited by examiner

*Primary Examiner*—Daniel P Stephenson
(74) *Attorney, Agent, or Firm*—Dave R. Hofman

(57) ABSTRACT

An extendable component for use in a downhole tool for traversing subsurface formations includes a drive element that defines an axis and has a distal end, and an abutment that is spaced radially from a distal end of the drive element. A driven element defines a driven element axis, is flexibly coupled to the drive element, and includes a proximal end disposed adjacent to the drive element and a distal end. A tilt arm is coupled to the driven element, is disposed at an angle with respect to the driven element axis, and is configured to engage the abutment. The driven element is moveable between a normal position and a tilted position. A contact head is coupled to the driven element distal end and is adapted to engage the wellbore wall.

25 Claims, 4 Drawing Sheets

DOWNHOLE TOOL HAVING AN EXTENDABLE COMPONENT WITH A PIVOTING ELEMENT

BACKGROUND

1. Technical Field

This disclosure generally relates to oil and gas well drilling and the subsequent investigation of subterranean formations surrounding the well. More particularly, this disclosure relates to apparatus and methods for disengaging or "unsticking" components of a tool from the wall of the well.

2. Description of the Related Art

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation permeability. These measurements are essential to predicting the production capacity and production lifetime of a subsurface formation.

One technique for measuring formation and fluid properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include a probe that may be pressed against the wellbore wall to establish fluid communication with the formation. This type of wireline tool is often called a "formation tester." Using the probe, a formation tester measures the pressure of the formation fluids and generates a pressure pulse, which is used to determine the fluid mobility or the formation permeability. The formation tester tool may also withdraw a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip" uphole. Further, the wireline tools must be lowered to the zones of interest, generally at or near the bottom of the hole. The combination of removing the drill string and lowering the wireline tool downhole is time-consuming and can take up to several hours, depending on the depth of the wellbore. Because of the great expense and rig time required to "trip" the drill pipe and lower the wireline tool down the wellbore, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling). A variety of downhole MWD and LWD drilling tools are commercially available.

MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms. Furthermore, LWD and MWD are not necessarily performed while the drill bit is actually cutting through the formation. For example, LWD and MWD may occur during interruptions in the drilling process, such as when the drill bit is briefly stopped to take measurements, after which drilling resumes. Measurements taken during intermittent breaks in drilling are still considered to be made "while-drilling" because they do not require the drill strings to be tripped.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The tool used to evaluate the formation is susceptible to becoming stuck to the wellbore wall. The pressure of the wellbore fluid, or mud, used to form the mudcake layer must be maintained at a higher level than the pressure of the formation to prevent the formation fluid from flowing out of the formation and quickly rising to the surface. Various chemical constituents are added to the mud to increase its density and overall weight, and to increase the pressure of the wellbore fluid, referred to as the hydrostatic pressure of "mud pressure." The difference between the mud pressure and the formation pressure is referred to as the "pressure differential." This difference is typically 2,000 psi or less, but may reach as high as 6,000 psi. If the pressure differential is positive (the pressure is overbalanced), then the fluid and solid content of the mud will tend to flow into the formation. If the pressure differential is negative (the drawdown pressure), then the fluid and solid content of the formation will tend to flow from the inside of the formation to the wellbore and upwards toward the surface. If a positive differential is maintained, then wellbore fluid and solid particles will flow from the wellbore into the formation, and the solid particles will stack up against the wall of the wellbore. Over time, the stacked particles will create the mudcake layer that seals between the wellbore and the formation. If the mudcake layer is removed from the wall of the wellbore, and if a positive pressure differential still exists, then the contents of the wellbore again will begin to flow into the formation and a new mudcake layer will be formed. The mudcake layer may have a thickness from a fraction of millimeter to ½ inch and more, depending on the permeability of the formation, mud type, drilling operations and procedures, and the prevailing pressure differential.

If the mudcake layer is removed or disturbed while a downhole tool is transported through the wellbore, then the tool can be drawn towards the wellbore wall due to the differential pressure and become stuck to the wall. This phenomenon is known as "differential sticking." The probability for the tool to become differentially stuck is primarily proportional to the following variables: (1) the amount of area of mudcake layer that has been removed or disturbed; (2) the amount of positive differential pressure; (3) the surface area of the tool that is in contact with the area of removed mudcake; (4) the amount of time the tool surface area is in contact with the area of removed mudcake.

In addition to the tool housing, components that are extended radially outwardly from the tool may be prone to differential sticking. During formation evaluation procedures, such as coring or formation fluid sampling, a piston and/or a probe are extended into contact with the mudcake. These extendable components may intentionally or inadvertently disrupt the seal formed by the mudcake layer, thereby exposing the component to the differential pressure. When the differential pressure is positive, it creates a force that holds the extendable component against the wellbore wall, thereby making it difficult to retract the component. Additionally, portions of the extendable component may become damaged or may break off and fall to the bottom of the wellbore, thereby interfering with subsequent drilling or other well operations. Known methods for disengaging downhole tools, such as fishing, cable pulling, and tool pushing by tubing, are overly difficult and time consuming.

SUMMARY OF THE DISCLOSURE

According to one embodiment of the disclosure, an extendable component of a downhole tool for use in a wellbore traversing subsurface formations is disclosed. The component includes a drive element, an abutment, a driven element, a tilt arm and a contact head. The drive element defines an axis and has a distal end, and the abutment is spaced radially from the drive element distal end. The driven element is flexibly coupled to the drive element and defines a driven element axis. The driven element also includes a proximal end disposed adjacent to the drive element and a distal end. The tilt arm is coupled to the driven element and is disposed at an angle with respect to the driven element axis. The driven element is also configured to engage the abutment and to be moveable between a normal position, in which the driven element axis is substantially parallel to the drive element axis, and a tilted position, in which the tilt arm engages the abutment so that the driven element axis is disposed at an angle with respect to the drive element axis. The contact head is coupled to the driven element distal end and is adapted to engage the wellbore wall.

According to another embodiment of the disclosure, a downhole tool for use in a wellbore traversing subsurface formations and defining a wellbore wall, is disclosed. The downhole tool includes an elongate housing defining a longitudinal axis and an extendable component associated with the housing. The extendable component includes an abutment, a drive element, a flexible coupling, a driven element, a tilt arm and a contact head. The drive element is slidably coupled to the housing and defines a drive element axis substantially perpendicular to the housing longitudinal axis. The drive element is also movable along the drive element axis between a retracted position and an extended position, and has a proximal end disposed inside the housing and a distal end. The abutment is spaced radially outwardly from the drive element distal end, and the flexible coupling is coupled to the shaft distal end. The drive element is coupled to the flexible coupling and defines a driven element axis. The tilt arm is coupled to the driven element and defines a leading contact point and a trailing contact point, such that the leading and trailing contact points are aligned along a contact reference line disposed at a tilt angle with respect to the driven element axis and is configured to engage the abutment. The driven element is movable from a normal position, in which the driven element axis is substantially parallel to the drive element axis, and a tilted position, in which the leading and trailing contact points engage the abutment so that the driven element axis is disposed at an angle with respect to the drive element axis. The contact head is coupled to a distal end of the driven element and is adapted to engage the wellbore wall.

According to another embodiment of the disclosure, a method of disengaging a contact head of an extendable component of a downhole tool from a wall of a wellbore traversing a subsurface formation, is disclosed. The method includes rotating a portion of the contact head away from the wellbore wall by tilting a driven element coupled to the contact head to leave a reduced surface area of the contact head that engages the wellbore wall, and retracting the driven element in a radially inward direction to separate the reduced surface area of the contact head from the wellbore wall.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

Figure 1:
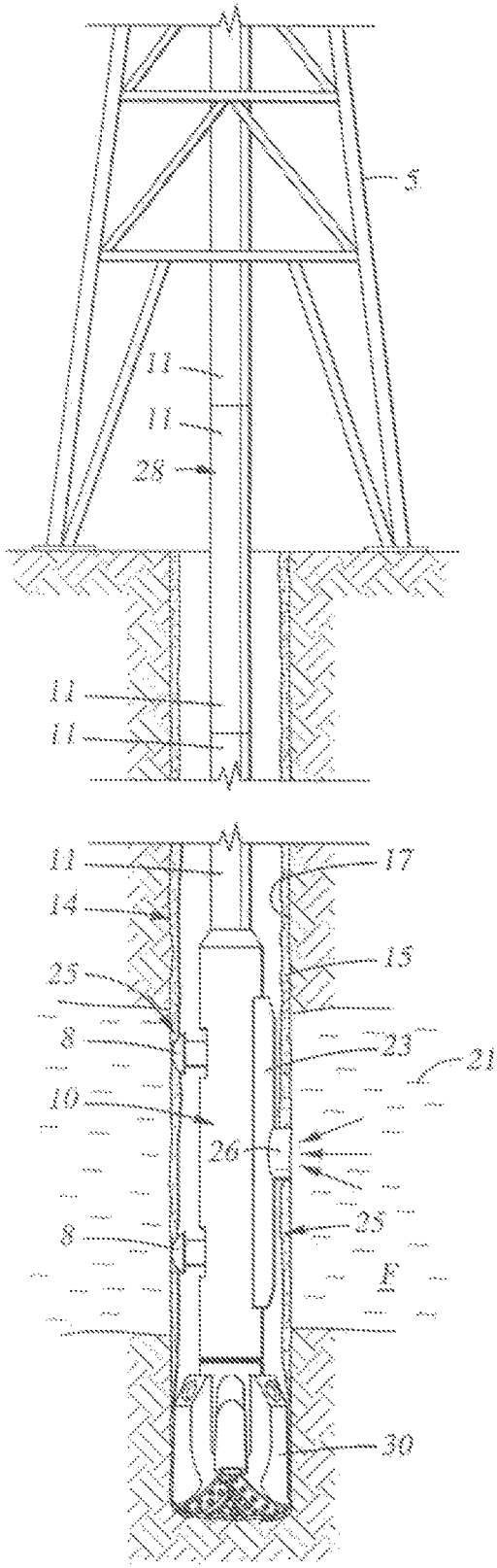
FIG. 1 is a schematic view, partially in cross-section, of a downhole tool with unsticking apparatus according to the present disclosure, in which the downhole tool is a downhole drilling tool.
Figure 2:
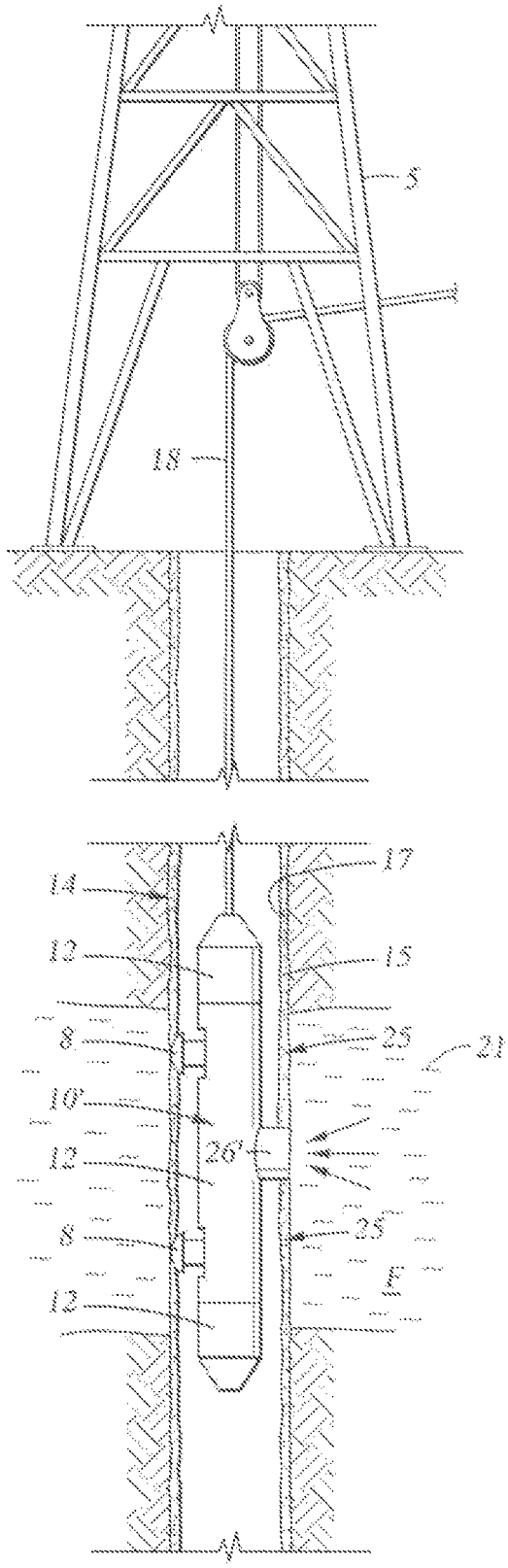
FIG. 2 is a schematic view, partially in cross-section, of a downhole tool with unsticking apparatus according to the present disclosure, in which the downhole tool is a wireline tool.

This disclosure relates to apparatus and methods for disengaging extendable components of downhole tools that are stuck to the wall of a wellbore, either in a drilling environment or in a wireline environment. The apparatus and methods disclosed herein tilt a follower shaft carrying a contact head that is stuck to the wellbore wall to effect a rolling motion of the contact head and reduce the effective holding force of the pressure differential that exists between the wellbore and the formation. As a result, the extendable component is more reliably disengaged from the wellbore wall and retracted back into the tool. In a refinement, the contact head is curved to promote the rolling motion of the head across the wellbore wall. In another refinement, the downhole tool may include a side piston to simultaneously move the tool in a transverse direction as the follower shaft is tilted.

in the exemplary embodiments, an extendable component according to the present disclosure is carried by a downhole tool, such as the drilling tool 10 of FIG. 1 or the wireline tool 10' of FIG. 2. The extendable component may also be used in any other type of tool that is inserted into or forms a wellbore.

FIG. 1 depicts a downhole drilling tool 10 deployed from a rig 5 and advanced into the earth to form a wellbore 14. The wellbore penetrates a subterranean formation F containing a formation fluid 21. The downhole drilling tool is suspended from the drilling rig by one or more drill collars 11 that form a drill string 28. "Mud" is pumped through the drill string 28 and out bit 30 of the drilling tool 10. The mud is pumped back up through the wellbore and to the surface for filtering and recirculation. As the mud passes through the wellbore, it forms a mud layer or mudcake 15 along the wellbore wall 17. A portion of the mud may infiltrate the formation to form an invaded zone 25 of the formation F.

The downhole drilling tool 10 may be removed from the wellbore and a wireline tool 10' (FIG. 2) may be lowered into the wellbore via a wireline cable 18. An example of a wireline tool capable of sampling and/or testing is depicted in U.S. Pat. Nos. 4,936,139 and 4,860,581, the entire contents of which are hereby incorporated by reference. The downhole tool 10' is deployable into wellbore 14 and suspended therein with a conventional wireline 18, or conductor or conventional tubing or coiled tubing, below the rig 5. The illustrated tool 10' is provided with various modules and/or components 12 including, but not limited to, a probe 26' for establishing fluid communication with the formation F and drawing the fluid 21 into the downhole tool as shown by the arrows. Backup pistons 8 may be provided to further thrust the downhole tool 10' against the wellbore wall 17 and assist the probe in engaging the wellbore wall 17. The tools of FIGS. 1 and 2 may be modular as shown in FIG. 2 or unitary as shown in FIG. 1, or combinations thereof.

Figure 4:
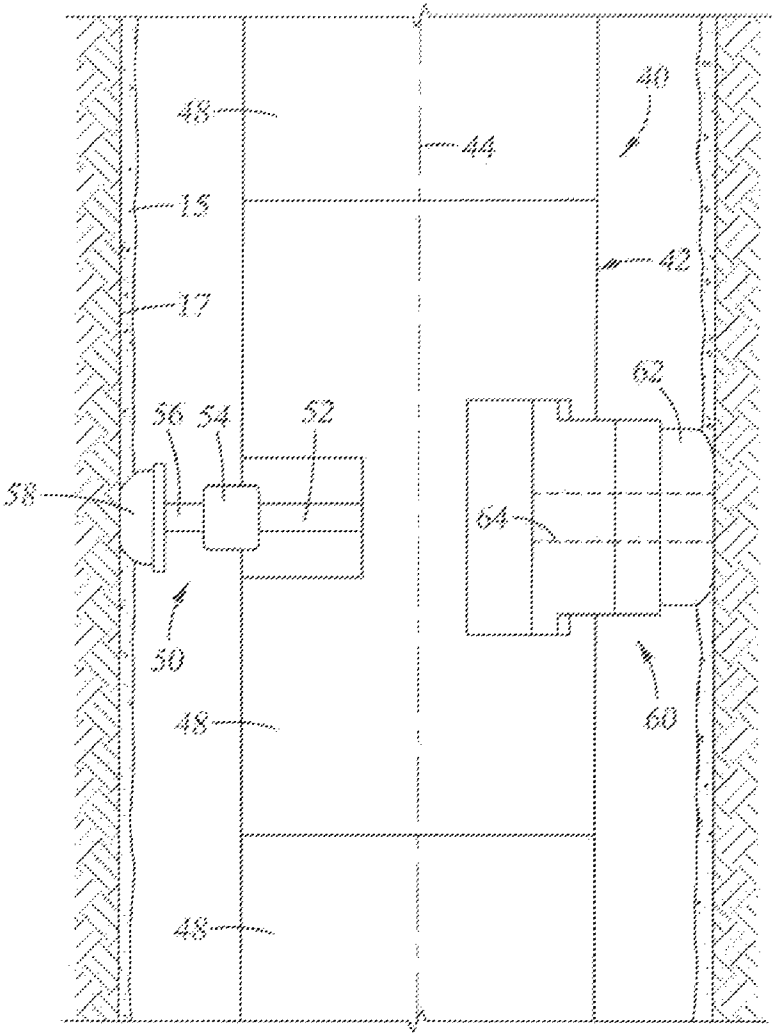
FIG. 4 is a side elevation view of a downhole tool having extendable components in extended positions, according to the present disclosure.
Figure 3:
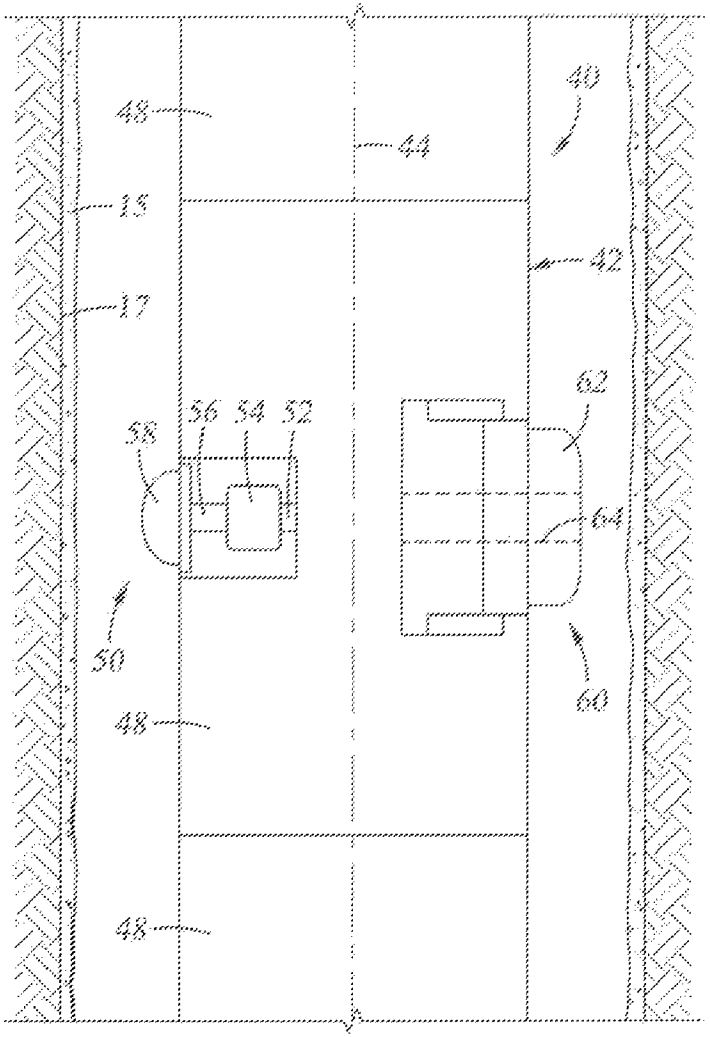
FIG. 3 is a side elevation view of a downhole tool with extendable components in retracted positions, according to the present disclosure.

FIGS. 3 and 4 illustrate a downhole tool 40 having extendable components according to the present disclosure. The downhole tool 40 includes an elongate housing 42 extending along an axis 44. The downhole tool 40 is sized for insertion into the wellbore wall 17 having the layer of mud cake 15 deposited thereon. As noted above, the downhole tool 40 may include several segments or modules 48 that are joined together to form a modular tool.

One of the extendable components provided with the downhole tool 40 is a backup shoe or backup piston 50. The backup piston 50 extends radially outwardly from the housing 42 to engage the wellbore wall 17, thereby to press the downhole tool 40 toward a diametrically opposed portion of the wellbore wall 17. As shown in FIG. 3, the backup piston 50 includes a drive element, such as a base shaft 52, and a joint housing 54 coupled thereto. A driven element, such as a follower shaft 56, is coupled to the base shaft 52 and carries a contact head in the form of a piston head 58. The backup piston 50 has a retracted position in which the piston head 58 is disposed nearer to the tool housing 42 and therefore is typically spaced from the wellbore 17, as illustrated in FIG. 3. The backup piston 50 may move radially outwardly from the retracted position to an extended position in which the piston head 58 is farther from the tool housing 42 to engage the wellbore wall 17 as illustrated in FIG. 4.

The downhole tool 40 also includes an extendable component in the form of a probe assembly 60. The probe assembly 60 includes a packer head 62 that may include multiple packer components such as inner and outer packets. A sample inlet 64 is provided for receiving formation sample material to be stored and/or evaluated. A guard may extend partially or entirely around the sample inlet 64 to prevent mud from infiltrating the formation sample. The probe assembly 60 has a retracted position in which the packer head 62 is nearer to the tool housing 42 and typically spaced from the wellbore wall 17. The probe assembly 60 is movable to an extended position in which the packer head is farther from the tool housing 40 and engages the wellbore wall 17 as illustrated in FIG. 4. When collecting formation samples, it is common to extend both the probe assembly 60 and the backup piston 50 to stabilize the position of the downhole tool 40 within the well.

The backup piston 50 includes a flexible connection between the base and follower shafts 52, 56 to facilitate a rolling motion of the piston head 58 during retraction, thereby to minimize the force holding the piston head 58 against the wellbore wall 17 should it become stuck. As illustrated in detail in FIG. 5A, the base shaft 52 defines a base shaft axis 84 and includes a distal end 70 that extends into an interior chamber defined by the joint housing 54. An anchor pin 72 is attached to the base shaft distal end 70. The joint housing 54 includes a flange section 74 extending outwardly from the base shaft 52 and a cylindrical wall section 76 extending radially outwardly form the flange section 74. An outer flange 78 extends inwardly from the cylindrical wall 76 and defines an abutment surface 80. The outer flange 80 defines an aperture that is sized to receive the follower shaft 56 with some additional clearance space.

The follower shaft 56 includes a distal end 90 coupled to the piston head 98 by a backing plate 92. The proximal end 94 of the follower shaft 56 is positioned adjacent to the distal end 70 of the base shaft 52. A tilt arm 96 is coupled to the follower shaft 56 and disposed within the joint housing 54. The tilt arm 96 is oriented along a contact reference line 98 which is disposed at a tilt angle "$\alpha$" with respect to a follower shaft axis 100. The angle alpha may be any angle other than 0 to 90 degrees so that the tilt arm 96 defines leading and trailing contact points 102, 104 disposed on opposite sides of the follower shaft 56. As used herein, the term "tilt arm" is intended to encompass any structure that presents leading and trailing contact points on opposite sides of the follower shaft 56.

Figure 5A:
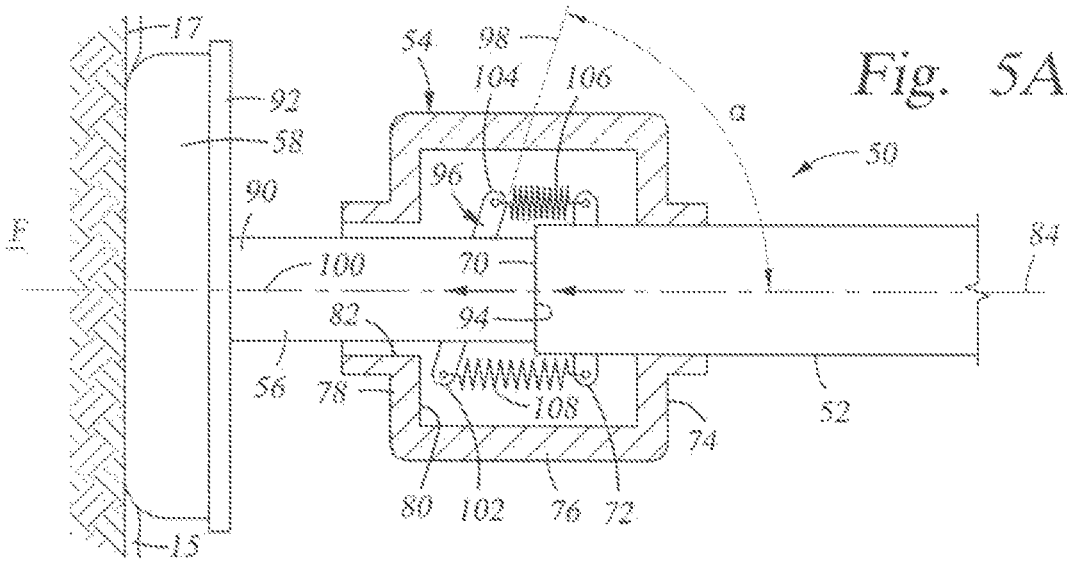
FIGS. 5A, 5B, and 5C are side elevation views, partially in cross-section, of a backup piston as it moves from an extended position to a retracted position.

The follower shaft 56 is flexibly coupled to the main shaft 52 to allow relative movement therebetween. As shown in FIG. 5*a*, springs 106, 108 extend between adjacent ends of the tilt arm 96 and anchor pin 72. The springs 106, 108 are placed in tension so that they exert a spring force that holds the follower shaft 56 in a normal position as shown in FIGS. 5A and 5C, in which the follower shaft proximal end 94 contacts the main shaft distal end 70.

Figure 5B:
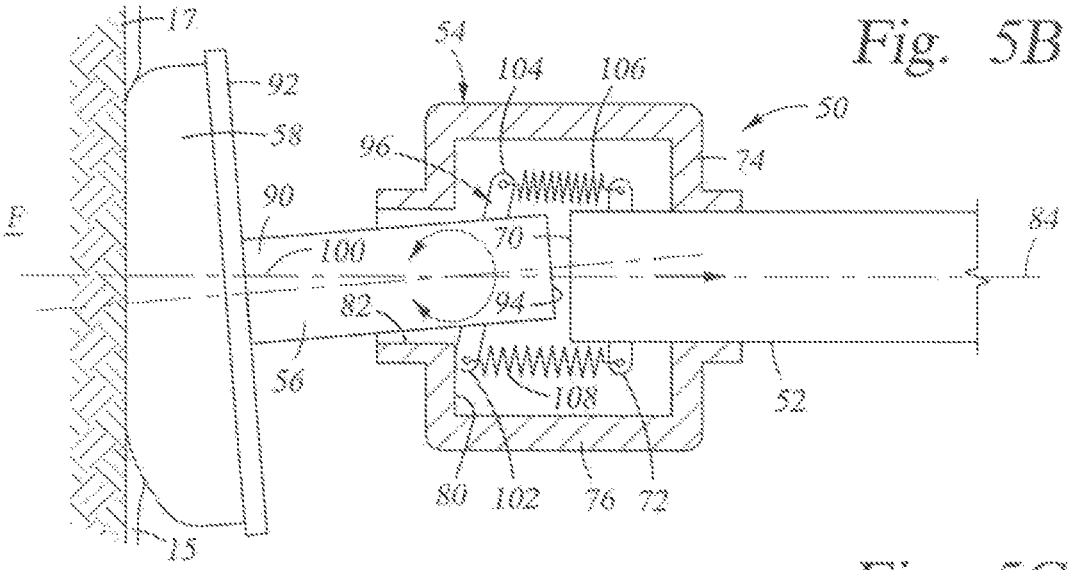

When the piston head is stuck to the wellbore wall 17 such that a holding force resists movement of the follower shaft 56 in a radially inward direction, the springs 106, 108 permit the main shaft 52 to move away from the follower shaft 56 as shown in FIG. 5B. AS the main shaft 52 continues to retract, the distance between the main shaft 52 and follower shaft 56 increases until the leading contact point 102 of the tilt arm 96 engages the abutment surface 80 of the joint housing 54. At this point, further separation of the main and follower shafts 52, 56 is prevented, but the angle of the tilt arm 96 allows the follower shaft 56 to rotate or tilt, as shown in FIG. 5B. The follower shaft 56 will continue to tilt until the trailing contact point 104 engages the abutment surface 80, at which time the follower shaft 56 will be held at a fixed angle. As evident from FIG. 5B, the follower shaft axis 100 is disposed at an angle with respect to the base shaft axis 84. By tilting the follower shaft 56 in this manner, a portion of the piston head 58 is rolled or pried out of contact with the wellbore wall 17. Accordingly, the holding force exerted by the differential pressure acts on a smaller effective area of the piston head 58, thereby decreasing the magnitude of the force needed to pull the piston head 98 entirely out of contact with the wellbore wall 17.

Figure 5C:
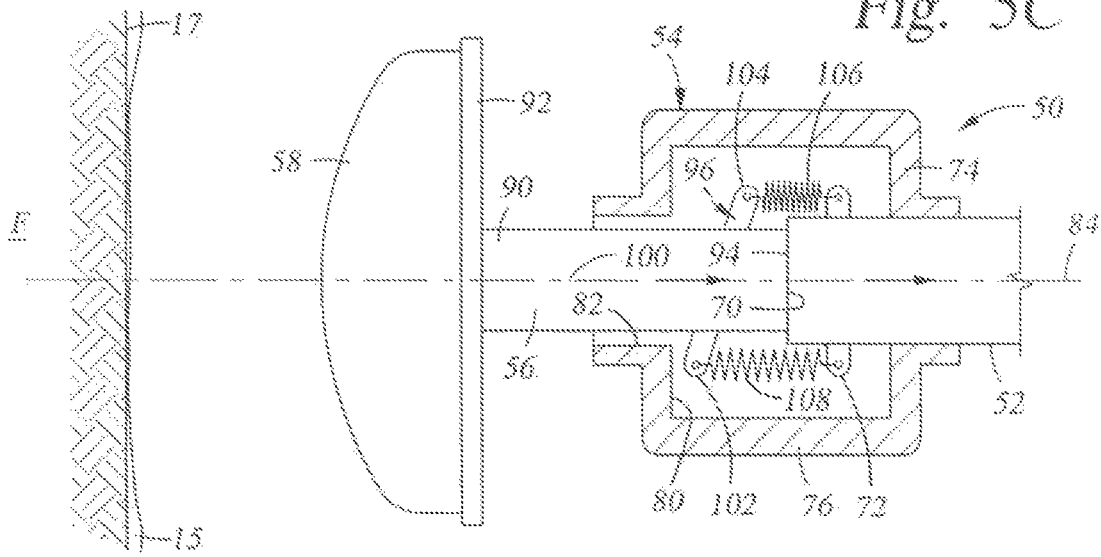

Once the piston head 58 is completely disengaged from the wellbore wall, the springs 106, 108 again pull the follower shaft 58 so that the follower shaft proximal end 94 abuts the main shaft distal end 70, as illustrated in FIG. 5C. The backup piston 50 may then be completely retracted with the follower shaft 56 in the normal position.

Figure 6:
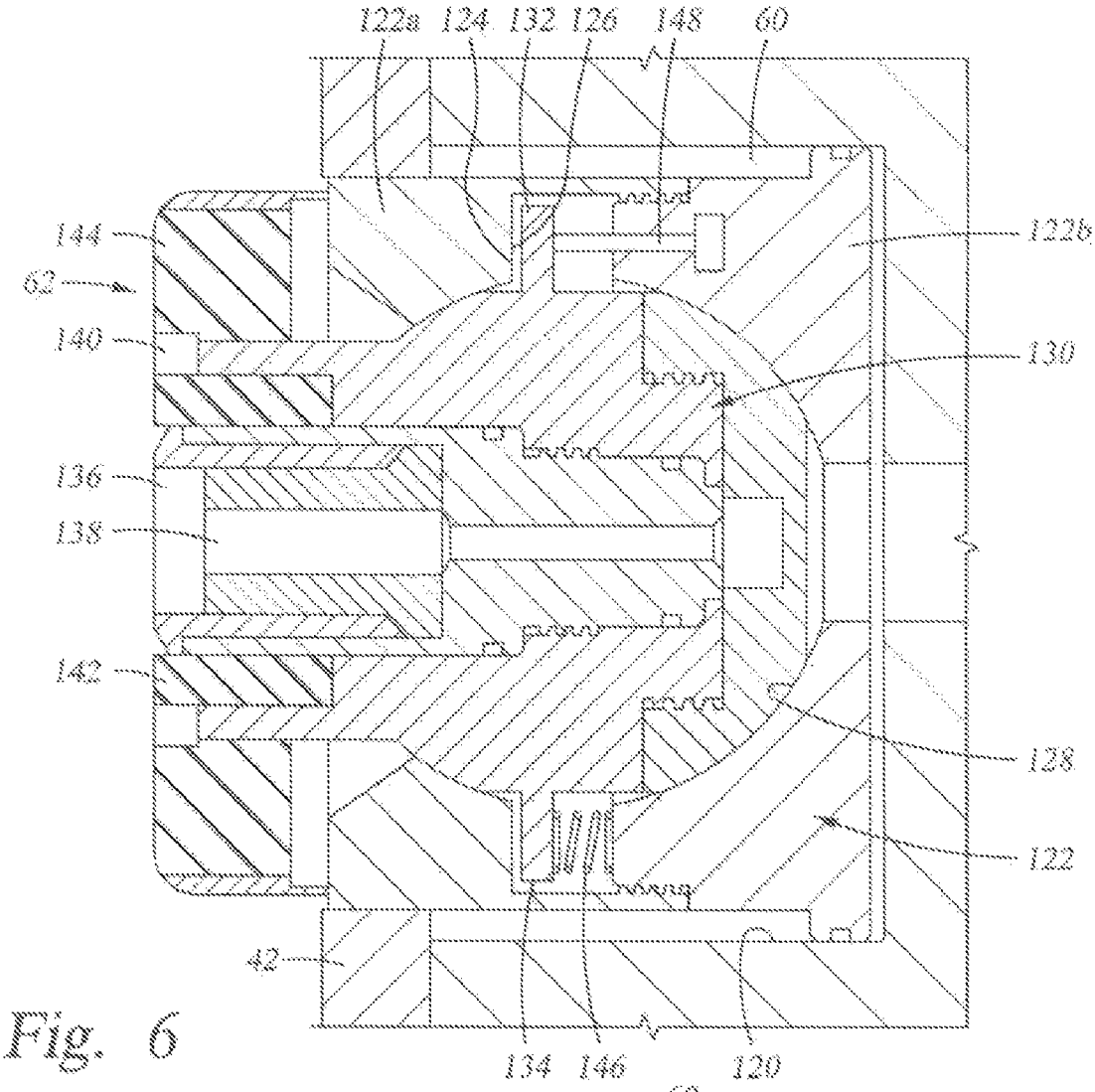
FIG. 6 is a side elevation view, in cross-section, of an extendable probe packer according to the present disclosure.

A similar flexible connection is provided in the probe assembly 60. As best shown in FIG. 6 the probe assembly is disposed in a cavity 20 formed in the tool housing 42. The probe assembly 60 includes a drive element in the form of a piston block 122 formed of two halves 122*a*, 122*b*. A shoulder 124 formed in the piston block half 122*a* defines an abutment surface 126. The piston block 122 also defines a central cavity for receiving a driven element, such as a sample base 130. The sample base 130 includes a tilt arm in the form of leading and trailing flanges 132, 134. A sample inlet 136 is coupled to the base 130 and includes an inlet conduit 138 through which formation fluid may be collected. An annular guard inlet 130 extends around the sample inlet 136 for preventing contaminated fluid from infiltrating the sample fluid received at the sample inlet 136. An inner packer 142 is disposed between the sample inlet 136 and guard inlet 140 and an outer packer 144 extends around a guard inlet 140. A more detailed explanation of sampling with a guard and sample inlets can be found in U.S. Pat. No. 6,964,301, with specific reference to FIGS. 5 and 6B, which in incorporated herein by reference for all purposes.

The probe assembly 60 is movable from a retracted position as illustrated in FIG. 6 to an extended position. The piston block 122 is sized to slide along the outer wall of the cavity 120 in a radially outward direction, thereby to place the packer 142, 144 into contact with the wellbore wall. Movement of the sample base 130 with respect to the piston block 122 is permitted by gaps between the leading and trailing flanges 132, 134 and the abutment surface 124. The sample base 130 is flexibly coupled to the piston block 122 by a spring 146 on one end and a piston 148 on an opposite end.

Should the packer head 62 become stuck to the wellbore wall, the radially offset positions of the leading and trailing flanges 132, 134 will automatically tilt the probe base 130 as the piston block 132 is retracted. More specifically, once the leading flange 132 engages the abutment surface 124, the sample base 130 will be rotated around the point of contact until the trailing flange also engages the abutment surface 124, at which point the probe base 130 will be held at a constant angle with respect to the piston block 132. Tilting of the probe base 130 will rotate a portion of the probe head 62 out of contact with the wellbore wall, thereby reducing the amount of surface head 62 in contact with the wellbore wall, and consequently, the effective holing force applied by the differential pressure. Once the entire probe head 62 is disengaged from the wellbore wall, the probe base 130 will return to the normal position and the probe assembly may be fully retracted.

Figure 7:
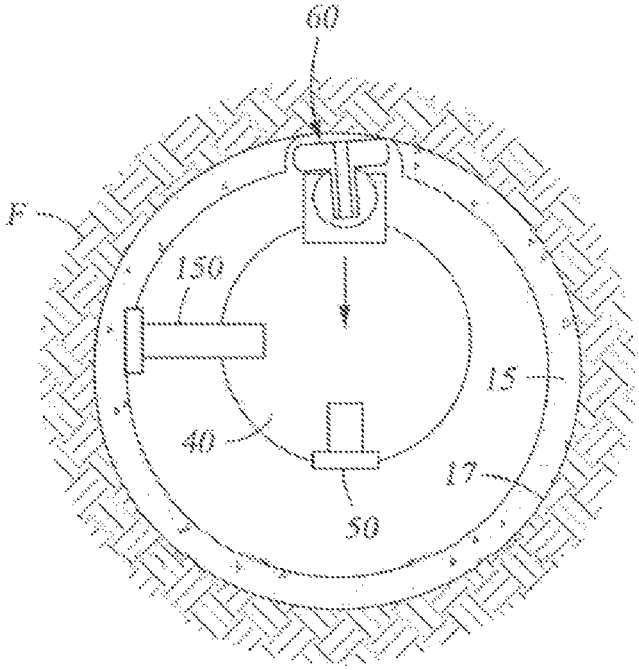
FIG. 7 is a plan view, in partial cross-section of a downhole tool having an extendable probe packer and side piston according to the present disclosure.

To promote additional rolling motion and to possibly alleviate shear stresses that may be exerted on the probe head 62 when the probe base 130 is tilted, the downhole tool 40 may further include a side piston 150 for moving the downhole tool 40 in a traverse direction, as shown in FIG. 7. The side piston 150 may be extended from a retracted position to an extended position in which it engages the wellbore wall 17 simultaneously as the probe assembly 60 is withdrawn. Extension of the side piston 150 introduces additional force which tends to roll the probe head 62 out of contact with the borehole wall 17, thereby more reliably disengaging the probe assembly 60 from the wall 17.

While the certain embodiments have been set forth, alternatives and modifications will be apparent from the above description to those skilled in the art. These and other alternatives are considered equivalents and within the spirit and scope of this disclosure and the appended claims.

What is claimed:

1. An extendable component of a downhole tool for use in a wellbore traversing subsurface formations and defining a wellbore wall, the extendable component comprising:

a drive element defining an axis and having a distal end;

an abutment spaced radially from the drive element distal end;

a driven element flexibly coupled to the drive element and defining a driven element axis, the driven element having a proximal end disposed adjacent to the drive element and a distal end;

a tilt arm coupled to the driven element, disposed at an angle with respect to the driven element axis, and configured to engage the abutment, the driven element being moveable between a normal position, in which the driven element axis is substantially parallel to the drive element axis, and a tilted position, in which the tilt arm engages the abutment so that the driven element axis is disposed at an angle with respect to the drive element axis; and a contact head coupled to the driven element distal end and adapted to engage the wellbore wall.

2. The extendable component of claim 1, in which the contact head comprises a curved external face.

3. The extendable component of claim 2, in which the curved external face has a radius of curvature that is less than that of the wellbore wall.

4. The extendable component of claim 1, in which the contact head comprises a piston head.

5. The extendable component of claim 1, in which the contact head comprises a probe packer.

6. The extendable component of claim 1, in which the tilt arm comprises a pin coupled to and extending from opposite sides of the driven element.

7. The extendable component of claim 1, in which the tilt arm comprises a pair of flanges extending from opposite sides of the driven element.

8. The extendable component of claim 1, in which a combination of at least one piston and at least one spring couples the driven element to the drive element.

9. The extendable component of claim 1, in which the extendable component comprises a backup piston, wherein the drive element comprises a base shaft and the driven element comprises a follower shaft.

10. The extendable component of claim 1, in which the extendable component comprises a probe assembly, wherein the drive element comprises a piston block and the driven element comprises a sample base.

11. The extendable component of claim 1, in which a set of springs couples the driven element to the drive element.

12. A downhole tool for use in a wellbore traversing subsurface formations and defining a wellbore wall, the downhole tool comprising:

an elongate housing defining a longitudinal axis;

an extendable component associated with the housing, the extendable component including:

a drive element slidably coupled to the housing and defining a drive element axis substantially perpendicular to the housing longitudinal axis, the drive element being movable along the drive element axis between a retracted position and an extended position, the drive element having a proximal end disposed inside the housing and a distal end;

an abutment spaced radially outwardly from the drive element distal end;

a flexible coupling coupled to the shaft distal end;

a driven element coupled to the flexible coupling and defining a driven element axis;

a tilt arm coupled to the driven element and defining a leading contact point and a trailing contact point, the leading and trailing contact points being aligned along a contact reference line disposed at a tilt angle with respect to the driven element axis and configured to engage the abutment, wherein the driven element is movable from a normal position, in which the driven element axis is substantially parallel to the drive element axis, and a tilted position, in which the leading and trailing contact points engage the abutment so that the driven element axis is disposed at an angle with respect to the drive element axis; and a contact head coupled to a distal end of the driven element and adapted to engage the wellbore wall.

13. The downhole tool of claim 12, further comprising an extendable side piston coupled to the housing and radially offset from the extendable component.

14. The downhole tool of claim 12, in which the contact head comprises a curved external face.

15. The downhole tool of claim 12, in which the curved external face has a radius of curvature that is less than that of the wellbore wall.

16. The downhole tool of claim 12, in which the contact head comprises a piston head.

17. The downhole tool of claim 12, in which the contact head comprises a probe packer.

18. The downhole tool of claim 12, in which a set of springs couples the driven element to the drive element.

19. The downhole tool of claim 12, in which the tilt arm comprises a pin coupled to and extending from opposite sides of the driven element.

20. The downhole tool of claim 12, in which the tilt arm comprises a pair of flanges extending from opposite sides of the driven element.

21. The downhole tool of claim 12, in which a combination of at least one piston and at least one spring couples the driven element to the drive element.

22. A method of disengaging a contact head of an extendable component of a downhole tool from a wall of a wellbore traversing a subsurface formation, the method comprising:

rotating a portion of the contact head away from the wellbore wall by tilting a driven element coupled to the contact head to leave a reduced surface area of the contact head that engages the wellbore wall; and retracting the driven element in a radially inward direction to separate the reduced surface area of the contact head from the wellbore wall;

wherein the driven element is flexibly coupled to a drive element;

wherein a tilt arm is coupled to the driven element, the tilt arm being disposed at an angle with respect to a tilt shaft axis and configured to engage an abutment spaced distally with respect to the drive element; and wherein retracting the drive element places the tilt arm in contact with the abutment to automatically tilt the driven element.

23. The method of claim 22, in which retracting the driven element is performed by further retracting the drive element in the radially inward direction.

24. The method of claim 22, further comprising displacing the downhole tool in a transverse direction simultaneously with rotating the portion of the contact head away from the wellbore wall.

25. The method of claim 24, in which the downhole tool further includes a side piston to displace the downhole tool in a transverse direction.

* * * * *